US007255301B2

(12) United States Patent
Schmidt-Hebbel et al.

(10) Patent No.: US 7,255,301 B2
(45) Date of Patent: Aug. 14, 2007

(54) REEL SPOOL STORAGE AND LOADING DEVICE AND METHOD

(75) Inventors: Harald Schmidt-Hebbel, Barueri (BR); John H. Schamell, Roscoe, IL (US); Gerald J. Kramer, Rockton, IL (US); Keith Sippel, Beloit, WI (US); Bradford Dolbey, Beloit, WI (US)

(73) Assignee: Andritz Tissue Inc., Janesville, WI (US)

( * ) Notice: Subject to any disclaimer, the term of this patent is extended or adjusted under 35 U.S.C. 154(b) by 334 days.

(21) Appl. No.: 11/002,435

(22) Filed: Dec. 3, 2004

(65) Prior Publication Data

US 2005/0189448 A1 Sep. 1, 2005

Related U.S. Application Data

(60) Provisional application No. 60/548,179, filed on Mar. 1, 2004.

(51) Int. Cl.
*B65H 19/22* (2006.01)

(52) U.S. Cl. ..... 242/533; 242/533.1; 242/533.2

(58) Field of Classification Search ..... 242/533, 242/533.1–533.3

See application file for complete search history.

(56) References Cited

U.S. PATENT DOCUMENTS

| | | | | |
|---|---|---|---|---|
| 1,949,997 | A * | 3/1934 | Fourness | 242/521 |
| 3,586,253 | A * | 6/1971 | Gilbank et al. | 242/533.1 |
| 3,727,854 | A | 4/1973 | Grotzbach | |
| 4,390,138 | A * | 6/1983 | Rohde et al. | 242/533.1 |
| 4,609,162 | A * | 9/1986 | Kataoka | 242/527.3 |
| 4,768,730 | A * | 9/1988 | Laine | 242/533.2 |
| 4,778,122 | A * | 10/1988 | Snygg | 242/533.1 |
| 4,905,925 | A * | 3/1990 | Kremar | 242/533.1 |
| 5,370,327 | A * | 12/1994 | Adamski | 242/533.1 |
| 6,047,916 | A * | 4/2000 | Onnerlov | 242/533.1 |
| 6,260,788 | B1 * | 7/2001 | Hultcrantz et al. | 242/533.2 |

FOREIGN PATENT DOCUMENTS

| | | |
|---|---|---|
| DE | 196 30 925 A1 | 2/1998 |
| EP | 0 943 569 A2 | 9/1999 |
| EP | 1 234 789 A2 | 8/2002 |
| JP | 60-6550 | 1/1985 |
| JP | 2-193847 | 7/1990 |
| WO | WO 98/33733 | 8/1998 |

OTHER PUBLICATIONS

International Search Report completed Apr. 14, 2005.

* cited by examiner

*Primary Examiner*—Gene O. Crawford
*Assistant Examiner*—Sang Kim
(74) *Attorney, Agent, or Firm*—Nixon & Vanderhye P.C.

(57) ABSTRACT

A plurality of upper spool rails arranged over a reel-up device. Each elevated rail temporarily stores reeling spools that are successively loaded into a reeling station to wind a web and form finished reels of paper. The elevated spool rails include: a first pair of parallel upper spool rails extending over the reel-up device and adapted to support a plurality of a first type of reeling spools; and a second pair of parallel upper spool rails spaced above the first pair, and adapted to a plurality of a second type of reeling spools.

27 Claims, 2 Drawing Sheets

REEL SPOOL STORAGE AND LOADING DEVICE AND METHOD

RELATED APPLICATION

This application is a continuation of and claims priority to U.S. Provisional Application No. 60/548,179, filed on Mar. 1, 2004, the entirety of which is incorporated by reference.

BACKGROUND OF THE INVENTION

The present invention relates to storing and loading spools to be used by reel-up machines that wind webs, e.g., tissue, onto successive spools to form web rolls. In particular, the invention relates to multiple elevations of spool storage rails associated with a reel-up.

Present reel-up machines use either a crane, or an automatic loading system, to move reel spools from a single upper elevation of storage rails to the primary arms of a reeling machine or into a similar pre-start spool position. U.S. Pat. Nos. 3,586,253 and 6,047,916, disclose exemplary reel-up machines having a single pair of rails to move and store empty reel spools across the upper elevation of a reel-up machine. The rails for the empty spools are arranged on a single elevation above the lower portion of the reel-up machine that winds a web onto a spool to form a web roll. When the web is completely wound onto a spool and the web roll is discharged from the reel-up machine, the spool is removed from the roll and processed. The spool is lifted to a single elevation of a pair of spool rails by a crane or other lifting system. A train of empty spools roll along the single elevation upper rails and towards the inlet of the reel-up machine.

Conventionally, the individual spool at the discharge end of the rails nearest the reeling station (reel drum) was the only spool that could be selected and moved down to wind the next roll of moving web. The conventional reel-up paper machine with single elevation upper rails is limited in that it can only load the one empty spool that is at the discharge end of the upper spool rail elevation. This conventional reel-up paper machine does not allow for one of a plurality of empty spools to be selected for moving into the winding or reeling station to wind the web.

Some reel-up machines require the segregation of reel spools, either because some spools go to different processes, are intended to run different grades of material, or may be in better or worse condition than the others and only used when the need arises. Some spools may be plain (no cover or core), some spools may have rubber covers, some spools may be core-type spools for use with slitters or for export rolls and have different numbers of cores, and some may be different diameters. There is a need to select between a plurality of available spools to be used to wind a web roll.

Mills operating reel-up machines with a single elevation of spool storage rails must plan properly with the production paper roll runs to make sure the correct reel spools are in the reel-up machine and, in particular, inserted into the pre-start position, usually primary arms, from the spool loader at the correct time to ensure that desired changes in the machine take place. Historically, when a spool (other than the spool naturally next in line on the rails) has been needed, the desired spool is stored at an off-machine location and the loading process is scheduled so that the spool is loaded into the machine at exactly the right time and position. At the same time, other empty reel spools may be taken and stored at a different location (rather than being temporarily stored on the upper rails). These spool changing situations require more operator involvement, more advanced planning and more movement of reel spools from one position to another.

BRIEF DESCRIPTION OF THE INVENTION

This invention and method allows machines to store and load two or more different classifications of reel spools in the same cross-machine orientation, saving time, building floor space and allowing faster and easier reel grade changes.

The invention uses storage rails at different vertical elevation levels to store reel spools of different diameters, types, conditions or other reasons for intentional separation to allow switching from one set of spools to another quickly and easily, without the need for queuing or advanced planning.

The invention may be embodied as a plurality of upper spool rails elevated above a reel-up device for reeling a web successively onto a plurality of reeling spools to form finished reels of paper, the spool rails comprising: a first elevation of upper spool rails elevated higher than a reeling station of the reel-up device and adapted to support a plurality of reeling spools, and a second elevation of parallel upper spool rails elevated above the first pair, and adapted to support a plurality of reeling spools. The reeling spools on the first elevation may be a first type of reeling spools without cores, and the reeling spools on the second elevation may be reeling spools having cores. There may also be more than two elevations of spool rails. Alternatively, the reel spools on the rails of the first and second elevations may be of a same type of spool. The spools may be loaded into the reel-up device from the first elevation spool rail or the second spool rail elevation. Alternatively, the spools may be loaded into the reel-up device from the first elevation spool rail and the second spool rail elevation stores the reeling spools for subsequent transfer to the rail of the first elevation. The first elevation of spool rails may be directly above the reeling station and the first spool rail elevation may extend horizontally beyond the spool rail of the second elevation. The spool rails may be each a pair of substantially horizontal or inclined rails.

The invention may also be a method for temporarily storing reeling spools and loading the spools into a reeling station of a reel-up device, said method comprising: storing a first group of the reeling spools on a first spool rail elevation; storing a second group of the reeling spools on a second spool rail elevation; selecting a reeling spool from one of the spool rail elevations; positioning the selected reeling spool to receive a web and engage the reeling station, and winding the web onto the selected spool to form a web roll. The method may further comprise removing the spool reel from the web roll; preparing the spool for reentering the machine, assigning the removed spool reel to be stored in the first or second group, and moving the removed spool reel to the spool rail elevation corresponding to the assigned group.

In addition, the invention may be embodied as web reeling device comprising: a reeling station comprising a rotating cylindrical drum arranged to engage a web; primary arms, or the like, adjacent the reeling station and adapted to lower a selected reeling spool to the reeling station, such that the web is sandwiched between the spool and the cylindrical drum; a first spool rail elevation higher than the reeling station and comprising a spool rail adapted to support a plurality of reeling spools, and a second spool rail elevation above the first elevation and comprising a spool rail adapted to a support a plurality of reeling spools. The web reeling device may include an elevator that successively transfers reeling spools from the spool rails of the first and second spool rail elevations and a reel spool lowering device that selectively moves reeling spools from said first and second elevations to the primary arm or pre-start position. The lowering device may be a pair of pivoting lowering arms or an elevator moving vertically with substantially linear motion. In addition, a spool crane may lift spools to the first and second spool rail elevations.

DETAILED DESCRIPTION OF THE INVENTION

Figure 1:
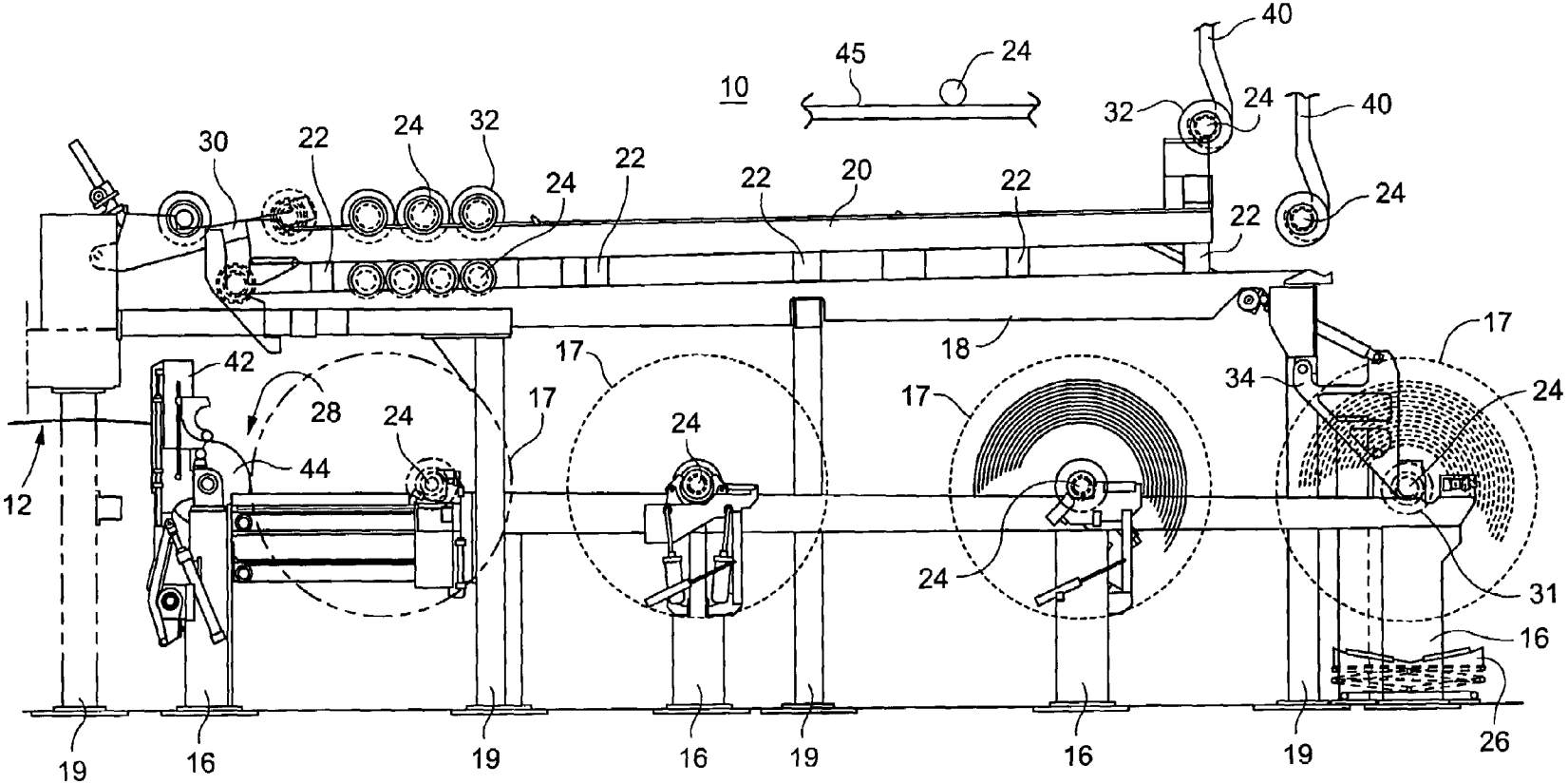
FIG. 1 is a side view of a reel-up machine having a plurality of spool storage rails.

FIG. 1 is a side-view of an exemplary reel-up machine 10 which winds a continuous web 12 on spools 24 to form paper rolls 17. The lower portion of the reel-up machine includes a reeling situation 28 and lower rails for moving the rolls, and a frame that includes one or more vertical posts 16. An upper portion of the reel-up machine comprises two or more elevations of rails 18, 20 to store empty spools. The stored spools are ready to be lowered and loaded into the reeling station 28 such that the web 12 can be wound around the spool.

The upper rails include a first elevation of a rail pair 18 and a second elevation of a rail pair 20, that is elevated over the first rail pair. Posts 19 support the upper rails 18, 20 of the reel-up machine. A series of struts 22 may support the second rail 20 pair over the first rail pair 18. The struts 22 and posts 19 supporting the first and second pair of rails may include the same posts 16 as support the lower portion of the reel up machine. Alternatively, one or both of the upper rails (or portions thereof) may be hung from a ceiling or other support above the upper rails 18, 20.

Each elevation of rails 18, 20 is substantially horizontal or inclined in the machine direction and arranged to receive an empty spool 24 at the rear of the rails and allow the spool to roll forward to the front of the rails. The rear and front of the lower rails 18 may extend horizontally beyond the rear and front of the upper rails 20 so that spools may be loaded and removed on and from the lower rails. The rails of each pair 18, 20 are spaced apart from each other vertically and horizontally so as to receive the empty spools. The empty spools may or may not have cores (depending on the reel-up machine and the reeling operation being preformed). The first rail pair 18 may be arranged to receive a different size and/or shape of spools than is received by the second rail pair 20. A crane and hook 40 may lift and load each of the empty spools on one of the pairs of rails 18, 20.

A reeling station 28 is in the lower portion of the reel-up machine 10. Empty spools 24 are selected from either the upper or lower elevation of rails, and lowered from the rails by a pair of pivoting lowering arms 30 to a set of primary arms 42, or other pre-start position at the reeling station 28 where the spool is spun and engages the web 12. The spool lowering assembly may be the lowering arms 30 and the primary arms 42. Alternatively, upper rail elevation may be used solely for storage and spools from the upper rail elevation are moved by a crane 40 to the rear of the lower rail. An exemplary device for transferring a spool from an upper rail to a reeling station is shown in U.S. Pat. No. 4,778,122, which is incorporated by reference. The web roll 17 is moved along a lower portion of the machine 10 to a roll discharge end 31.

At the discharge end 31, the cores 24 may be extracted from the rolls at a spool extracting station using equipment which may include a side conveyor 26, where a core 32 may be slid over the empty spool. The empty spool 24 is lifted by a pair of arms 34 to the crane 40 or to one of the rail elevations 18, 20. Alternatively, the entire roll with spool may be moved to an unwinding apparatus. When the empty spool has been returned, a human operator or automatic controller determines which rail elevation 18 or 20 on which to load the empty spool.

The web product 12 may be, for example, paper, tissue, textile, plastics, films or polymer webs. The term "tissue" may be a web material having a width greater than 10 inches (254 mm) and is wound onto any type of spool such as spools with cylindrical cores, shafts, or the like.

The spools 24 are temporarily stored on the upper rails 18, 20 prior to moving them by lowering arms 30 to a pre-start position on the primary arms 42. The spools are rotationally accelerated and are moved by the primary arms 42 against a rotating reel drum 44 of the reeling station 28. The web 12 is transferred to the spinning spool 24. Some reels (or reel-up devices) do not have primary arms, although a typical reel (or reel-up device) does have primary arms. Similarly, some reeling stations 28 have reel drums 44 and others do not. The term "reel up device" covers all winding machines that wind a web onto shafts, such as reel spools. The term reel spool 24 is intended to cover all spool types that are used to wind rolls of tissue upon and are suitable for being temporarily stored on upper rails of a reel-up machine. Various types of reel spools may be temporarily stored in one of the rail elevations 18, 20, and moved into position to receive the web at an appropriate time.

An advantage of a plurality of spool rail elevations 18, 20 is that each elevation of rails may store a different size, type or shape of spools 24. Because different types of spools are stored on the different rail elevations 18, 20 above the reeling station 28, the spool to be loaded into the reeling station 28 may be selected from either the first or second rail elevations 18, 20. Accordingly, by providing two (or more 45) elevations of spool rail elevations 18, 20, a selection of one of a plurality of spools to load into the reeling machine 28 can be made by commanding the lowering arms 30 to lift the selected spool from either the first or second pair of rails.

The first and second pair of rail elevations 18, 20 may comprise two or more levels overhead storage rails at different elevations for storing reel spools 24. There may be one or more devices, e.g., lowering arms 30, for moving a selected reel spool from the overhead storage rail elevations 18, 20 to the reeling machine 28 and in position in which web transfer will occur to the selected spool.

Figure 2:
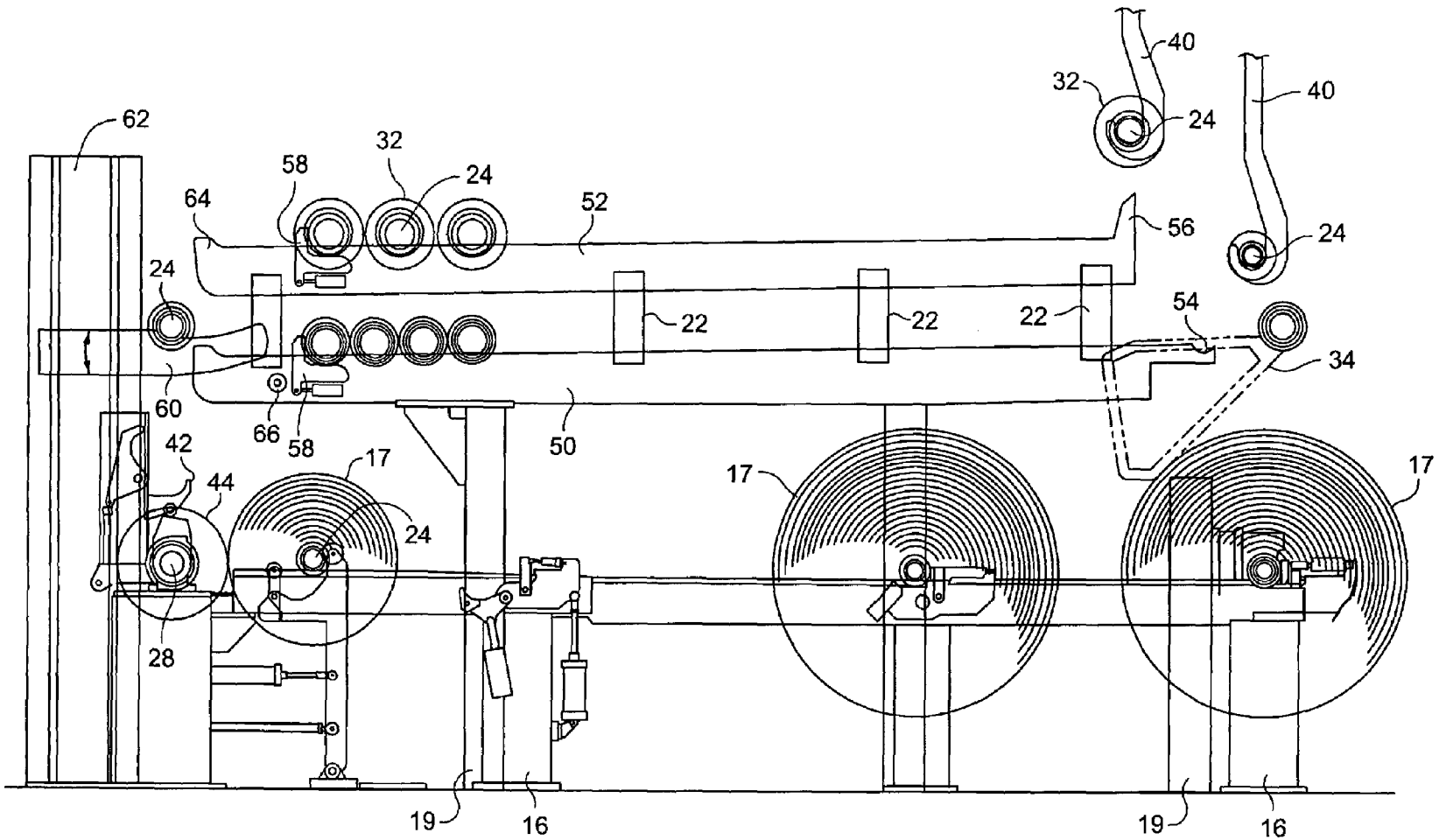
FIG. 2 is a side view of a reel-up device having another embodiment of multiple spool storage rails.

FIG. 2 shows spools 24 with cores 32 (Type A) on upper storage rails 20 and spools 24 without cores (Type B) on lower storage rails 18. The Type A and Type B spools symbolize different types of spools that a mill desires or needs to separate and have available for loading into the reeling machine 28. Common reasons for needing different types of spools include, but are not limited to: different diameters of spools; different spool covers (plain shell, rubber/polyurethane or other cover, cores of various materials, etc.); different number of cores (for 1, 2, 3, 4, 5 or more slitter cuts); different spool weights; different brands or types of shafts (expandable bladder, expandable leaf, spring loaded, etc); different turn-up processes (vacuum spools or non-vacuum, glue, tape or other processes) and other reasons that may exist for having different types of spools.

While two elevations of rails 18, 20 are shown, there may be three or more elevations of rails to hold three 45 or more different types of spools. The additional levels of rails could be added, for example, above and/or below those shown on in FIG. 1. Any type of spools may be stored on any rail level. Each pair of rails 18 or 20 may preferably store a single type of spools. However, different types of spools may be loaded on a single rail, provided that the scheduling for unloading spools from the rails is properly arranged. For example, a lower rail elevation 18 may have different types of spools not commonly used, and the upper rail elevation 20 may have a single type of spool that is most commonly used. The lower rail elevation may be used only when the rarely used spools are needed.

As required by the web 12 grades manufactured on the machine 10, the correct type of spool 24 would be moved from the respective rail where it resided and placed into the lowering arm 60 of the elevator 62. The elevator 62 is used in place of the lowering arms shown in FIG. 1. The arms 60 of the elevator lower the selected spool 24 to where is will be loaded to the pre-start position of the reeling machine 28. This may occur in one or more stages, with zero or multiple transfers. For example, an elevator type device 62 with the ability to raise and lower spools could vertically move to the proper elevation of the desired spool, accept it from the rail or other loading device intended to place it into the elevator, then lower the spool 24 to the primary arms 42 or pre-start position for acceleration against the reeling drum 44. The upper, lower, (and intermediate, if applicable) storage rails are designed so the raising/lowering device 62 can move the spools past the rails, either by moving the reel spools away from the rails and moving to the primary arms 60 or by having a hinged section in the rails so the elevator type device 62 could lift the spool 24 from the appropriate rail elevation, 18 or 20, and the rails below the spool would swing about pivot point 66 and move out of the path of spools in the elevator from above.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A plurality of upper spool rails elevated for a reel-up device for temporarily storing reeling spools before being successively loading into a lower reeling station of the reel-up device, the spool rails comprising:

a first elevation of an upper spool rail elevated higher than the reeling station of the reel-up device and adapted to support a plurality of reeling spools;

a second elevation of an upper spool rail above the first elevation and adapted to support a plurality of reeling spools, wherein the reeling spools on the first elevation and the second elevation have no wound web, and a spool lowering assembly adjacent the reeling station and adapted to lower a first selected reeling spool to the reeling station from the first elevation and a second selected reeling spool to the reeling station from the second elevation.

2. A plurality of upper spool rails as in claim 1 wherein the reeling spools on the first elevation are empty reeling spools without cores and the reeling spools on the second elevation are empty spools with cores.

3. A plurality of upper spool rails as in claim 1 further comprising at least a third elevation of an upper spool rail.

4. A plurality of upper spool rails as in claim 1 wherein the reel spools on the rails of the first and second elevations are of a same type of spool.

5. A plurality of upper spool rails as in claim 1 wherein the spools on the first elevation are a different type of spools than on the second elevation.

6. A plurality of upper spool rails as in claim 1 wherein the first elevation of upper spool rail are directly above the reeling station.

7. A plurality of upper spool rails as in claim 1 wherein the spool rail of the first elevation extends horizontally beyond the spool rail of the second elevation.

8. A plurality of spools as in claim 1 wherein the spool rail on each of the first elevation and second elevation further comprise a pair of parallel rails.

9. A plurality of rails as in claim 1 wherein the spool rail on each of the first elevation and second elevation are substantially horizontal.

10. A plurality of rails as in claim 1 wherein the spool rail on each of the first elevation and second elevation are both inclined downward towards the reeling station.

11. A method for temporarily storing reeling spools and loading the spools into a reeling station of a reel-up device, said method comprising:

a. storing a first group of the reeling spools on a first spool rail elevation higher than the reeling station;

b. storing a second group of the reeling spools on a second spool rail elevation higher than the reeling, wherein the second spool rail is at least partially over the reeling station and above the first rail elevation;

c. selecting a first reeling spool from a first one of the spool rail elevations;

d. lowering the selected first reeling spool to receive a web and engage the reeling station;

e. winding the web onto the selected first reeling spool to form a web roll f. selecting a second reeling spool from a second one of the spool rail elevations;

g. lowering the selected second reeling spool to receive a web an engage the reeling station, and h. winding the web onto the selected second reeling spool to form a web roll.

12. A method as in claim 11 wherein the first group of reeling spools are reeling spools without cores and the second group of reeling spools are reeling spools with cores, and the selection of reeling spools further comprises a selection of reeling spools with or without cores.

13. A method as in claim 11 further comprising a third spool rail elevation and the selection of the reeling spool further comprises selecting a spool on one of the first, second and third spool rail elevations.

14. A method as in claim 11 further comprising removing the reel spool from the web roll; preparing the removed spool for receiving another web roll; assigning the removed and prepared spool to be stored in the first or second group, and moving the removed and prepared spool reel to the spool elevation corresponding to the assigned group.

15. A method as in claim 11 further comprising storing a third group of the reeling spools on a third spool rail elevation.

16. A method as in claim 11 wherein the first spool rail elevation is vertically below the second spool rail elevation.

17. A method as in claim 11 wherein the first spool rail elevation and second spool rail elevations are each a pair of substantially horizontal rails, and said method further comprises rolling the spool rails across the pairs of substantially horizontal rails.

18. A method as in claim 11 wherein the first spool rail elevation and second spool rail elevation are each a pair of inclined rails, and said method further comprises rolling the spool rails across the pairs of inclined rails.

19. A web reeling device comprising:

a reeling station comprising a rotating cylindrical drum arranged to engage a web;

a spool lowering assembly adjacent the reeling station and adapted to lower a selected reeling spool to the reeling station, such that the web is sandwiched between the spool and the cylindrical drum;

a first spool rail elevation higher than the reeling station and comprising a spool rail adapted to support a plurality of reeling spools, wherein the reeling spools have no wound web, and a second spool rail elevation above the first elevation and comprising a spool rail adapted to a support a plurality of reeling spools, wherein the reeling spools have no wound web, and further wherein the spool lowering assembly lowers a selected reeling spool to the reeling station from the first spool rail elevation and lowers another selected reeling spool to the reeling station from the second spool rail elevation.

20. The web reeling device of claim 19 wherein the spool lowering assembly comprises a pair of primary arms that successively transfers reeling spools from the spool rails of the first and second spool rail elevations to the reeling station.

21. The web reeling device of claim 20 wherein the spool lowering assembly further comprising a reeling spool selection device adapted to selectively move reeling spools directly from said first elevation to the primary arms and directly from said second elevations to the primary arms.

22. The web reeling device of claim 19 wherein the selection device is a pair of pivoting lowering arms.

23. The web reeling device of claim 19 wherein the selection device is a substantially vertical elevator.

24. The web reeling device of claim 19 further comprising a spool crane to lift spools to the first and second spool rail elevations.

25. The web reeling device of claim 19 wherein the spool rail of the first spool rail elevation extends horizontally beyond the spool rail of the second spool rail elevation.

26. The web reeling device of claim 19 wherein the spool rail of each of the first and second spool rail elevations are a pair of substantially horizontal spool rails.

27. The web reeling device of claim 19 wherein the spool rail of each of the first and second spool rail elevations are both inclined downwards towards the reeling station.

* * * * *